United States Patent [19]

Maertens

[11] Patent Number: 4,730,994

[45] Date of Patent: Mar. 15, 1988

[54] COMPRESSOR WITH IMPROVED EXPOSED OUTBOARD THRUST PLATE AND METHOD OF ASSEMBLY

[75] Inventor: Michael J. Maertens, Adrian, Mich.

[73] Assignee: Tecumseh Products Company, Tecumseh, Mich.

[21] Appl. No.: 940,852

[22] Filed: Dec. 12, 1986

[51] Int. Cl.[4] ..... F04B 17/00; F04B 39/02

[52] U.S. Cl. ..... 417/572; 417/902; 418/63

[58] Field of Search ..... 417/366, 369, 572, 901, 417/902; 418/63; 220/DIG. 29, 67

[56] References Cited

U.S. PATENT DOCUMENTS

| | | | |
|---|---|---|---|
| 1,680,535 | 8/1928 | Gary | 220/67 |
| 1,967,035 | 7/1934 | Lipman | 417/372 |
| 2,130,349 | 9/1938 | Kucher | 230/139 |
| 2,135,881 | 11/1938 | Wentworth | 417/902 X |
| 2,324,434 | 7/1943 | Shore | 417/356 |
| 2,612,311 | 1/1949 | Warrick et al. | 417/410 |
| 2,618,430 | 11/1952 | Smith | 230/58 |
| 2,871,793 | 2/1959 | Michie et al. | 417/356 |
| 3,082,937 | 3/1963 | Tucker | 418/88 |
| 3,285,504 | 11/1966 | Smith | 417/902 X |
| 3,820,921 | 6/1974 | Thayer | 417/902 X |
| 4,057,979 | 11/1977 | Abell et al. | 417/902 X |
| 4,324,171 | 4/1982 | Gaylord et al. | 92/169 |
| 4,605,362 | 8/1986 | Sturgeon et al. | 418/63 |
| 4,629,403 | 12/1986 | Wood | 418/63 X |

*Primary Examiner*—Leonard E. Smith
*Assistant Examiner*—Eugene L. Szczecina, Jr.
*Attorney, Agent, or Firm*—Jeffers, Hoffman & Niewyk

[57] ABSTRACT

A hermetically sealed rotary compressor and its method of assembly are disclosed, which compressor and method utilize an end plate having an annular groove on its interior surface and an annular recess on its exterior surface. A securing weld in the centroidal plane of the end plate is provided at the junction of a compressor housing mated with the end plate annular groove.

6 Claims, 3 Drawing Figures

COMPRESSOR WITH IMPROVED EXPOSED OUTBOARD THRUST PLATE AND METHOD OF ASSEMBLY

BACKGROUND OF THE INVENTION

This invention relates to hermetic compressors and in particular to the construction and mounting of an outboard thrust plate for a rotary hermetic compressor.

Conventional rotary hermetic compressors for compressing a gas such as a refrigerant include a hermetically sealed housing shell within which are disposed an electric motor, a compressor cylinder block having a bore therein, a housing cavity, and a crankshaft which is rotatably driven by the motor. The crankshaft is generally journalled in one or more bearings which may be secured to either the housing or the compressor cylinder block. In general, when a main bearing and an outboard bearing are used for journalling the crankshaft, the cylinder block is sandwiched between these two bearings. The outboard bearing also serves as an end plate for sealing the cylinder bore which forms the compression chamber. In some compressors only a single bearing is used and an end plate is provided and functions only as an end wall for the compressor cylinder bore. One example of such construction is shown in U.S. Pat. No. 2,458,018.

Sealing and assembly of hermetic compressors present difficulties as compressor housings are somewhat flexible, connections to suction or discharge to both the cylinder block and housing must be sealed, and there is relative movement between the housing and compressor cylinder. The relative movement between the cylinder block and housing have been accommodated in the prior art. However, remaining assembly problems include sealing the end plate and preventing distortion or warpage of the end plate by sealing methods such as welding.

Small hermetic rotary compressors for use with household appliances and the like must be kept desirably small. In U.S. Pat. No. 2,612,311, this size constraint has been achieved by combining the end plate of the compressor with the compressor housing end wall. However, this disclosed arrangement includes providing the suction tube through the sidewall of the housing, which leads to undesirable assembly or leakage problems.

Sealing the housing of rotary compressors with an end plate, especially horizontal hermetic rotary compressors, has proven to be a difficult and continuing assembly problem. Various methods have been attempted to effectively seal the housing for hermetic operation while avoiding any distortion to the internal mechanisms during assembly. An obvious problem is warpage or distortion associated with the dissipation of heat during a sealing operation, such as welding. However, an exposed outboard thrust plate arrangement must be mounted to seal the crankcase cavity and thereafter must be secured by welding without warpage.

Joining and sealing the housing and end plate by welding is accepted practice in the industry. However, welding entails inherent rapid heating and elevated temperatures in the welded parts, and heat-induced stresses from welding are generally produced along the flat surfaces of the end plate.

In the present compressor arrangement, the compressor outboard or end thrust plate supports the compressor cylinder block and forms an end wall of the housing.

The end thrust plate is sealingly secured to the housing shell member and, as illustrated, includes a suction aperture communicating with the compression chamber of the cylinder block. The end thrust plate has a crankshaft bearing and a lubrication passage with its lower end disposed in the oil sump and its upper end communicating with an axial bore of the crankshaft. The compressor thrust end plate forms part of the housing to improve cooling of the compressor over conventional cooling arrangements, supports the cylinder block at its a thrust bearing surface and provides support for the rotating end surface of the crankshaft. These multiple functions of an end plate indicate the necessity for maintaining the structural integrity during compressor assembly to prevent run-out and vibration in the compressor after the end plate is sealingly secured to the housing.

An arrangement to accommodate such crankshaft and sealing operations of an end plate is illustrated in U.S. Pat. No. 2,612,311—Warrick et al, wherein the end plate 45 is fitted into the mouth 22*a* of shell 22. Mouth and shell members are preferably provided with complementary interfitting, aligning surfaces.

U.S. Pat. No. 3,482,937—Tucker discloses an end plate 18 in casing element 10 at its open end and secured therein by welding. However, end plate 18 is not a thrust bearing element in this structure.

Illustrated in U.S. Pat. No. 2,324,434—Shore is an end plate structure for a compressor wherein the end plate provides an intake conduit 42 leading from the refrigerating system to a central orifice 43 past hub 11 of base 4. Shaft 13 is a stationary shaft and fixed in place by set screw 14. Thus, there is no rotational or vibrational effect from a slight variation in the concentricity of the bore retaining such shaft. However, end member or end plate 4 is only secured in casing 1 by flanging the rim of the casing inwardly against packing 5.

U.S. Pat. No. 2,871,793—Michie et al illustrates a pump and electric motor combination wherein end plate 16 is press-fit into a rabbet 15 of shell 13. The end plate is thereafter annularly welded to the shell 13 as indicated at 17. Shaft 23 is a fixed shaft welded to end plate 16 and thus is not subject to dramatic effects from small variations in the concentricity of its bore or bearing boss 24.

SUMMARY OF THE INVENTION

The present invention encompasses a unique end plate structure and its incorporation into a hermetically sealed rotary compressor assembly. The improved end plate minimizes warpage associated with welding, protects against introduction of foreign matter into the compressor housing cavity at final assembly and provides ease of compressor assembly with a ready means for setting the depth or coupling of the housing and end plate. The end plate and housing are secured by welding at the centroidal plane of the end plate. Welding along a plane parallel to the faces of the end plate and at a neutral axis thereof minimizes deformation in the relatively thin, flat, plate-like structure and enables the manufacturer to maintain the assembly tolerances of his engineering specifications. Heat-induced stresses from welding are accommodated by an annular recess on the exterior surface of the end plates to minimize warping, especially in and around the generally centrally located bearing member of this end plate. Further, an annular groove or recess on the bearing or interior surface of the end plate accommodates a mating housing member. The mating parts seal the crankcase cavity prior to weldment, thus preventing weld spatter from entering that critical space, as well as giving the assembler a means to minimally adjust the final assembly structure prior to welding.

The invention, in one form thereof is a compressor comprising a housing with a closed end and an open end sealed by an end plate, which cooperates with the housing to define a housing cavity. The housing cavity broadly includes a crankshaft, drive motor and a cylinder block with a compression chamber for compression of a compressible fluid during crankshaft rotation. The end plate includes an interior surface and an exterior surface and has a centroidal plane through the end plate center of mass, which is approximately midway between interior and exterior surfaces. A groove, generally on the end plate interior surface, mates with the housing and a weldment is provided about the housing and end plate approximatelv in the centroidal plane.

The invention in accordance with another embodiment thereof comprises the method of assembling the compressor by providing the housing and the end plate, which has an annular groove on its interior surface and a stress relief annular recess on its exterior surface, thereafter mating and adjusting the housing and end plate in the groove, and welding the mated housing and end plate at their intersection in the end plate centroidal plane.

BRIEF DESCRIPTION OF THE DRAWING

In the figures of the drawing, like reference numerals identify like components and in the drawing.

DETAILED DESCRIPTION OF THE INVENTION

Figure 1:
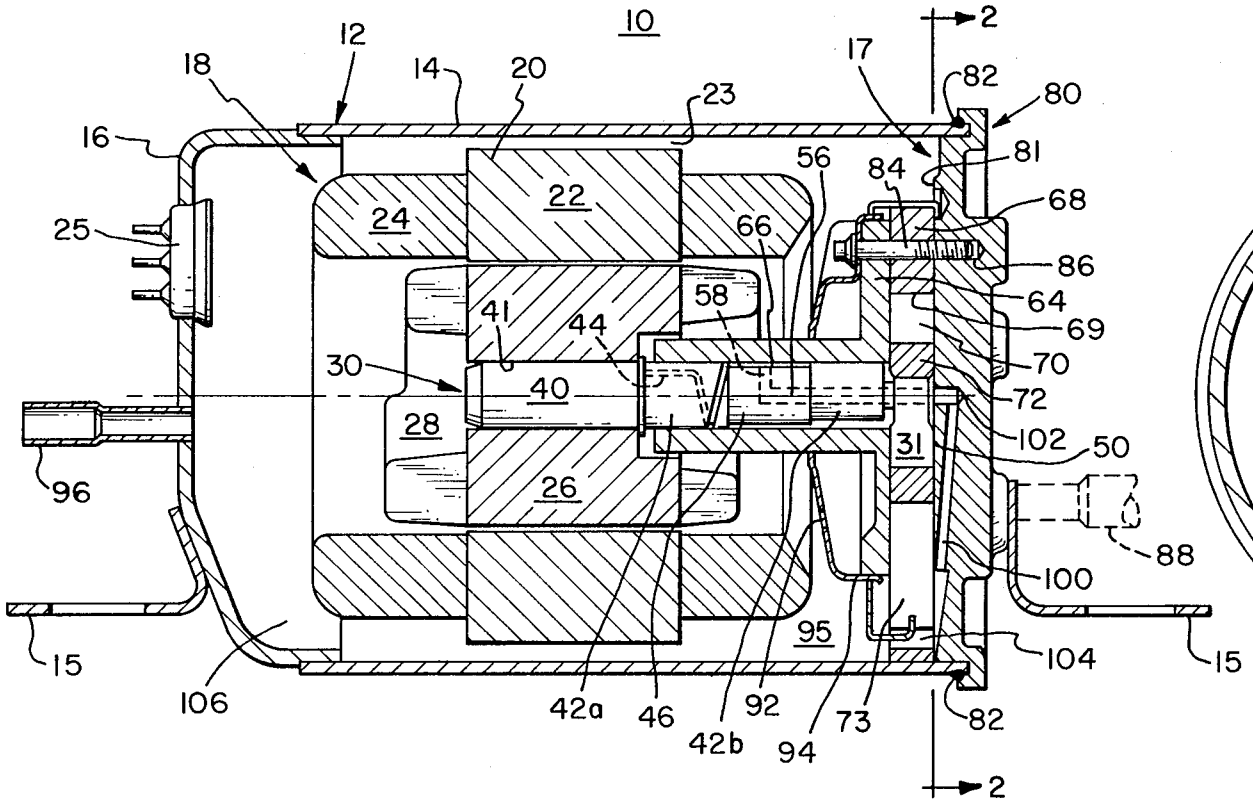
FIG. 1 is an elevational view in cross-section of a preferred embodiment of the hermetic compressor and end plate of the present invention.

FIG. 1 illustrates a hermetically sealed rotary compressor assembly 10 having a bell housing or shell 12 with a centrally located cylindrical portion 14, a bell end portion 16, an open end 17, and an end plate 80. Cylindrical portion 14 and end bell portion 16 are sealingly secured to each other by means known in the art, such as welding. Alternatively, these elements may be formed as a unit such as by deep drawing. End plate 80 is mounted in open end 17 and cooperates with housing 12 to define a housing cavity 95. A pair of mounting brackets 15 is provided for mounting compressor 10. An electric motor 18 is disposed in housing cavity 95 and includes a stator 20 having a stack of stator laminations 22 and stator windings 24. Stator 20 is secured to housing shell 12 in any convenient manner such as by an interference fit. Stator 20 includes two flat portions on its circumference whereby a clearance or a gap 23 is provided between a portion of stator lamination stack 22 and housing shell 12 as shown in FIG. 1. An electrical connector 25 is secured to shell end portion 16 for connection to a source of electrical supply (not shown). Electric motor 18 has a rotor 26 provided with a counterweight 28 for balancing the rotor and a crankshaft 30, which crankshaft includes an eccentric portion 31. Crankshaft 30 has a portion 40 secured in a bore 41 of rotor 26, such as by press-fitting, two bearing portions **42*a* and 42*b*, and an undercut portion 46. Bearing portion 42*a* is provided with a helical passageway 44 in its outer surface for lubrication purposes. An end thrust bearing surface 50 on eccentric 31 is also included on crankshaft 30. Eccentric 31 and bearing portion 42*b* are provided with oil grooves (not shown) and crankshaft 30 has an axial bore 56 communicating with a radial oil passage 58 in undercut portion 46**.

In FIG. 1, a journal bearing 64 is provided for crankshaft 30. Undercut portion 46 of crankshaft 30 cooperates with bearing 64 to define annular chamber 66 and thus a continuous lubrication circuit from axial bore 56 through radial passage 58 to annular chamber 66 and helical passageway 44.

Figure 2:
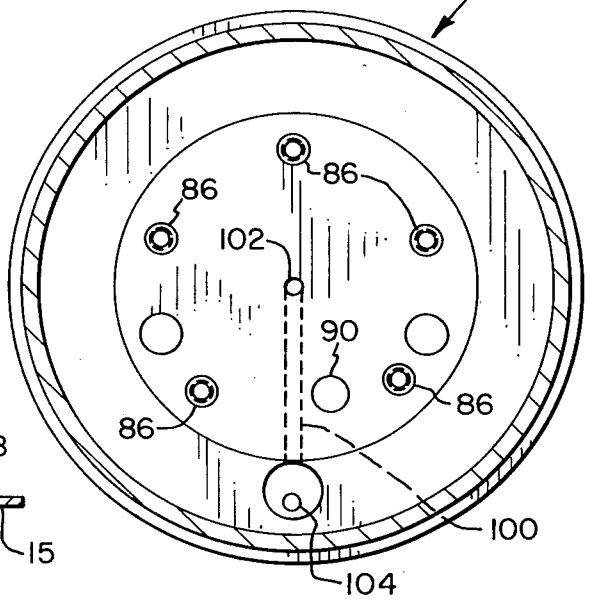
FIG. 2 is an end view of the end plate taken along line 2—2 of FIG. 1.
Figure 3:
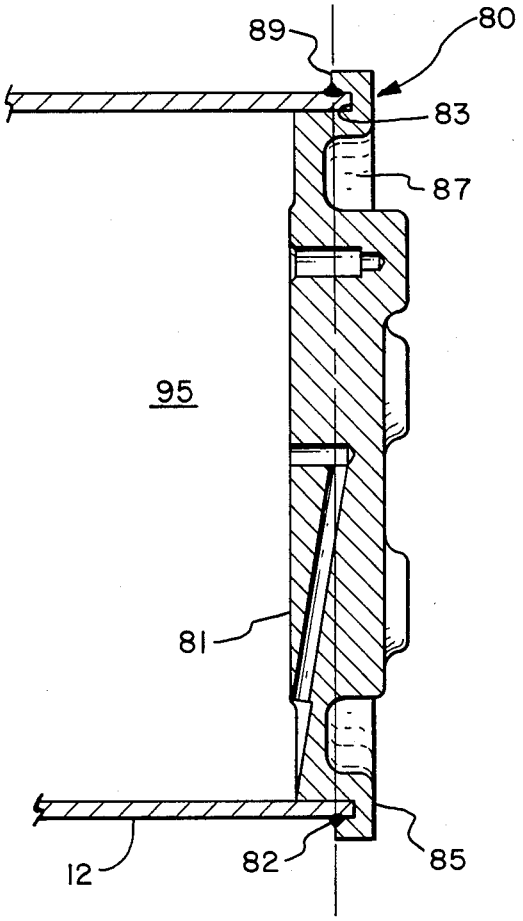
FIG. 3 is a cross-sectional, enlarged view of the end plate of FIG. 1.

A compressor cylinder block 68 is positioned in compressor 10, which block 68 defines an axial bore 69. End plate 80 with a predetermined wall thickness is shown in FIGS. 1, 2 and 3 for sealing housing 12 by suitable means, such as welding, at a circumferential weld 82. End plate 80 is secured to journal bearing 64 by means of bolts 84 which engage threaded apertures 86 of end plate 80. Compressor cylinder block 68, secured between journal bearing 64 and end plate interior surface 81, cooperates with bearing 64 and surface 81 to define compression chamber 70 in the axial bore 69. A suction tube 88 for inlet gas is secured to an aperture 90 of end plate 80. A roller 72 surrounds eccentric 31 in compression chamber 70 and cooperates with a sliding vane 73 in a conventional manner for compressing a compressible gas, such as a refrigerant, in compression chamber 70.

End plate 80, illustrated in FIGS. 1–3 as a circular shape but not limited thereto, includes a radial passage 100 and axial passage 102. Axial passage 102 is aligned with axial bore 56. Axial passage 104 in cylinder block 68 communicates between radial passage 100 and oil sump 106 defined by housing 12. As crankshaft 30 is rotated by motor 18, oil is drawn upwardly through passages 104, 100 and 102 from sump 106, due to a suction pressure generated by the rotation of helical oil groove 44 in crankshaft 30. Oil flows through axial passage 104, radial passage 100, axial passage 102, axial bore 56, and radial passage 58 to annular chamber 66, to lubricate the bearings of crankshaft 30.

End plate 80, which functions as a thrust plate at interior surface 81, has suction tube 88 mounted in suction aperture 90. Thrust bearing 50 of crankshaft 30 bears against interior or thrust bearing surface 81 defined by end plate 80. End plate 80 further defines an annular groove 83 at a radial distance from thrust bearing surface 81 and generally near the perimeter of end plate 80; and, an exterior surface 85 with an annular recess or depression 87.

As noted and clearly shown in FIG. 3, annular recess 83 on interior face or surface 81 provides a mating site for housing 12 prior to welding with weld bead 82. This arrangement securely locates thrust bearing surface 81 within housing 12 prior to weldment. Housing 12 and end plate 80 are adjustable to firmly fix dimensional tolerances of the final assembly prior to welding.

Outer edge 89 of groove 83 is generally located along a plane parallel to thrust bearing surface 81 and exterior surface 85 through the centroid or center of mass of end plate 80. Therefore, weldment 82 joining housing 12 and end plate 80 is provided about the centroidal junction of outer edge 89 and housing 12.

Annular recess 87 on exterior surface 85 provides a means for end plate 80 to flex and thereby accommodate or dissipate the stresses introduced into end plate 80 and housing 12 during welding at weld bead 82. Thus the end plate 80 and housing 12 are maintained in relatively unchanged relationship and the interior bearing surface 81 is not distorted, warped or otherwise affected by the heat of welding. Housing cavity 95 is insulated and protected from weld spatter by the mating and overlap position of end plate 80 and housing 12 prior to welding. Therefore, assembly of hermetically sealed compressors is dramatically enhanced by improving the assembly characteristics, protecting the components from distortion, and avoiding variation in internal parameters and structures after assembly through accommodation of heat distortion during welding.

In operation, compressible gas flows into compressor 10 through suction tube 88 and aperture 90 to compression chamber 70 and is compressed by operation of roller 72 and a sliding vane 73 as crankshaft 30 is rotatingly driven by rotor 26 of motor 18. Thereafter, the compressed gas discharged through a discharge valve (not shown), a discharge muffler 94, aperture 92, housing cavity 95 and is communicated through discharge tube 96 to the condensor of a refrigeration circuit as known in the art.

Those skilled in the art will recognize that certain variations can be made in the illustrative embodiment. While only specific embodiments of the invention have been described and shown, it is apparent that various alternatives and modifications can be made therein. It is, therefore, the intention in the appended claims to cover all such modifications and alternatives as may fall within the scope of the invention.

What is claimed is:

1. A hermetically sealed rotary compressor comprising:

a housing having an open end and a closed end;

an end plate sealing said open end and cooperating with said housing to define a housing cavity; and means for compression of gaseous fluids positioned in said housing cavity; said end plate including an interior surface, an exterior surface, a groove at the perimeter of said interior surface, and a centroidal plane through the center of mass of said end plate generally parallel to and approximately midway between said interior and exterior surfaces, wherein said housing matingly contacts said groove and said housing cavity is hermetically sealed by a weldment joining said housing and said end plate approximately in said centroidal plane.

2. A hermetically sealed rotary compressor as claimed in claim 1 wherein said end plate exterior surface defines a stress-relief annular recess.

3. A hermetically sealed compressor comprising:

a housing defining an open end and a closed end, an end plate mounted on said housing to seal said open end and cooperate with said housing to define a housing cavity, an electric motor including a rotor and stator, a crankshaft secured to and operable by said rotor, said electric motor and crankshaft positioned in said housing cavity;

a cylinder block and journal bearing positioned in said housing cavity, which cylinder block and bearing cooperate with said end plate to define a compression chamber, and means for compression of gaseous fluids positioned in said compression chamber and operable by said crankshaft;

said end plate including an interior thrust bearing surface, an exterior surface, an annular groove at approximately the perimeter of said interior surface, and a centroidal plane through the center of mass of said end plate generally bisecting the thickness of said end plate wherein said housing matingly contacts said annular groove and is hermetically sealed to said end plate by a weldment about said housing approximately in said centroidal plane.

4. A hermetically sealed rotary compressor as claimed in claim 3 wherein said exterior surface defines a stress-relief annular recess.

5. A hermetically sealed rotary compressor as claimed in claim 3 wherein said annular groove is defined by said interior surface and is radially disposed outwardly of said thrust bearing surface and inwardly of the perimeter of said end plate, the outer edge of said annular groove located approximately in said centroidal plane, the weldment located at the juncture of the outer edge of said annular groove and said housing.

6. A method of sealing and relieving welding stresses at assembly of a hermetically sealed rotary compressor which comprises the steps of:

(1) providing a compressor housing and an end plate defining an interior surface with an annular groove and an exterior surface with a stress relief annular recess, said end plate having a centroidal plane through the center of mass of said end plate generally parallel to and approximately midway betwen said interior and exterior surfaces, (2) mating said compressor housing into said end plate groove;

(3) adjusting said housing in said groove to its proper depth; and (4) welding said housing and end plate at their juncture in said centroidal plane.

* * * * *